US011005211B2

(12) United States Patent
Iwase

(10) Patent No.: US 11,005,211 B2
(45) Date of Patent: May 11, 2021

(54) METHOD FOR MANUFACTURING CABLE WITH CONNECTOR AND CABLE WITH CONNECTOR

(71) Applicant: Tokyo Electron Limited, Tokyo (JP)

(72) Inventor: Masayuki Iwase, Miyagi (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 16/561,271

(22) Filed: Sep. 5, 2019

(65) Prior Publication Data

US 2020/0136304 A1 Apr. 30, 2020

(30) Foreign Application Priority Data

Oct. 29, 2018 (JP) ..... JP2018-203270

(51) Int. Cl.

| | |
|---|---|
| ***H01R 13/58*** | (2006.01) |
| ***H01R 43/00*** | (2006.01) |
| ***H01B 13/00*** | (2006.01) |
| ***H01B 7/17*** | (2006.01) |
| ***H01B 7/10*** | (2006.01) |

(52) U.S. Cl.

CPC ..... *H01R 13/58* (2013.01); *H01B 7/102* (2013.01); *H01B 7/17* (2013.01); *H01B 13/0036* (2013.01); *H01R 43/00* (2013.01)

(58) Field of Classification Search

CPC ..... H01R 43/00; H01R 13/58; H01R 13/5833

See application file for complete search history.

(56) References Cited

U.S. PATENT DOCUMENTS

| | | | | | |
|---|---|---|---|---|---|
| 1,705,075 | A * | 3/1929 | Stoddard | F21V 27/02 | 439/452 |
| 2,143,985 | A * | 1/1939 | Kellems | F16G 11/02 | 403/72 |
| 3,603,913 | A * | 9/1971 | Hasty, Jr. | H01B 17/58 | 439/471 |
| 3,786,554 | A * | 1/1974 | Little | F16G 11/048 | 29/461 |
| 3,951,504 | A * | 4/1976 | Clark | H01R 13/56 | 439/451 |
| 3,997,234 | A * | 12/1976 | Worman | H01R 13/6335 | 439/456 |
| 4,070,083 | A * | 1/1978 | DiPalma | H01R 13/562 | 439/445 |
| 4,491,381 | A * | 1/1985 | Hamsher, Jr. | H01R 23/6873 | 439/267 |
| 4,509,877 | A * | 4/1985 | Sobin | D04C 1/06 | 24/115 N |
| 4,900,266 | A * | 2/1990 | Sainsbury | H01R 13/58 | 439/451 |
| 6,441,311 | B2 * | 8/2002 | Fukumoto | H01R 4/70 | 174/138 F |

(Continued)

FOREIGN PATENT DOCUMENTS

JP 2009-037945 2/2009

*Primary Examiner* — Briggitte R. Hammond
(74) *Attorney, Agent, or Firm* — IPUSA, PLLC

(57) ABSTRACT

A method for manufacturing a cable with a connector is provided. In the method, a contact is attached to a reinforcing wire. The reinforcing wire to which the contact is attached is inserted into an insertion portion of a housing. The housing is connected to one end of a cable. The reinforcing wire is secured to the cable by a securing member.

7 Claims, 6 Drawing Sheets

(56) References Cited

U.S. PATENT DOCUMENTS

| | | | | |
|---|---|---|---|---|
| 6,699,063 | B2 * | 3/2004 | Lebender | H01R 13/5804 174/152 G |
| 6,705,896 | B1 * | 3/2004 | Chang | H01R 12/592 439/607.44 |
| 8,253,021 | B2 * | 8/2012 | Adachi | H02K 5/225 174/72 A |
| 8,523,607 | B2 * | 9/2013 | Sakurai | H01R 43/24 439/540.1 |
| 9,666,979 | B1 * | 5/2017 | Zucker | H01R 13/5804 |
| 2019/0020147 | A1 * | 1/2019 | Devoe | H01R 13/5833 |

* cited by examiner

METHOD FOR MANUFACTURING CABLE WITH CONNECTOR AND CABLE WITH CONNECTOR

CROSS-REFERENCE TO RELATED APPLICATION

The present application is based on and claims priority to Japanese Priority Application No. 2018-203270 filed on Oct. 29, 2018, the entire contents of which are hereby incorporated herein by reference.

BACKGROUND OF THE INVENTION

1. Field of the Invention

The present disclosure relates to a method for manufacturing a cable with a connector and a cable with a connector.

2. Description of the Related Art

A substrate processing apparatus is known that performs a desired process such as a film deposition process on a substrate. The substrate processing apparatus includes a temperature sensor that detects a temperature of a measurement object. The temperature sensor is connected, for example, via a removable connector. For example, during maintenance of the substrate processing apparatus, the connector is detached.

Japanese Patent Application Publication No. 2009-37945 discloses a cable manufacturing method and a cable that is protected from disconnection.

SUMMARY OF THE INVENTION

In one aspect, the present disclosure provides a method for manufacturing a cable with a connector and a cable with a connector.

According to an embodiment, there is provided a method for manufacturing a cable with a connector. In the method, a contact is attached to a reinforcing wire. The reinforcing wire to which the contact is attached is inserted into an insertion portion of a housing. The housing is connected to one end of a cable. The reinforcing wire is secured to the cable by a securing member.

Additional objects and advantages of the embodiments are set forth in part in the description which follows, and in part will become obvious from the description, or may be learned by practice of the disclosure. The objects and advantages of the disclosure will be realized and attained by means of the elements and combinations particularly pointed out in the appended claims. It is to be understood that both the foregoing general description and the following detailed description are exemplary and explanatory and are not restrictive of the disclosure as claimed.

DETAILED DESCRIPTION OF THE PREFERRED EMBODIMENTS

Figure 1:
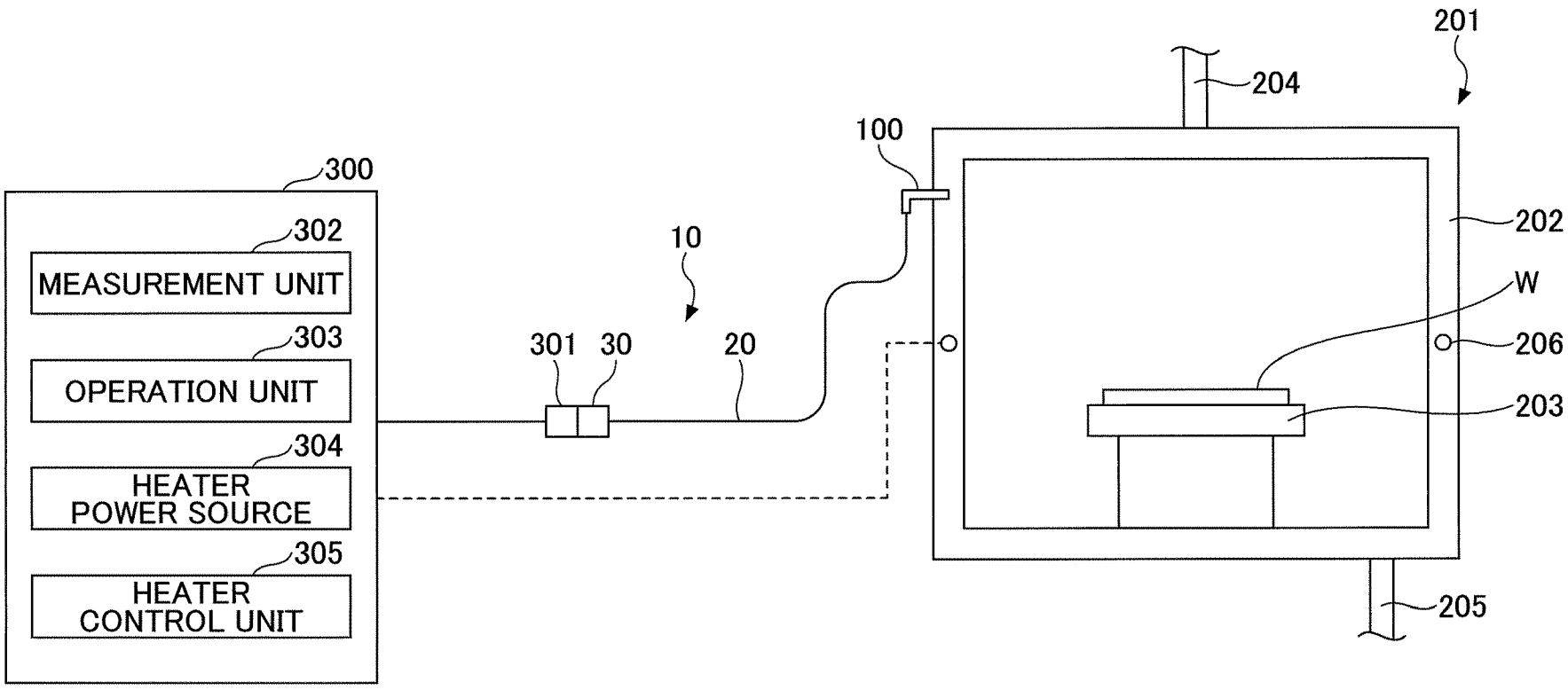
FIG. 1 is a schematic configuration diagram illustrating an example of a substrate processing apparatus in which a cable with a connector is used according to an embodiment.

Hereinafter, embodiments for carrying out the present disclosure will be described with reference to the drawings. In each drawing, the same reference numerals are used for the same components and overlapping descriptions may be omitted.

[Substrate Processing Apparatus]

Before describing a cable with a connector 10 according to an embodiment, an example of an apparatus in which the cable with the connector 10 according to an embodiment is used will be described with reference to FIG. 1. FIG. 1 is a schematic configuration diagram of an example of a substrate processing apparatus 201 in which the cable with the connector 10 is used, according to an embodiment.

A substrate processing apparatus 201 is an apparatus that performs a predetermined process (for example, an etching process, a film deposition process, a cleaning process, an ashing process and the like) on a substrate such as a wafer W. The substrate processing apparatus 201 includes a chamber 202, a stage 203 on which a wafer W is placed, a gas supply unit 204 for supplying a process gas, and a gas exhaust unit 205 for evacuating a post-processing gas.

A heater 206 that heats the chamber 202 is disposed inside a side wall of chamber 202. The heater 206 is controlled by a temperature control unit 300. The side wall of the chamber 202 also includes a temperature sensor 100 for detecting the temperature of the chamber 202. The temperature sensor 100 is connected to the temperature control unit 300 via a cable 10 with a connector 30.

The temperature control unit 300 is connected to the temperature sensor 100 and the heater 206 to adjust the temperature of the chamber 202 to a desired temperature. The temperature control unit 300 includes a connector 301, a measuring unit 302, a calculation unit 303, a heater power source 304, and a heater controller 305.

The connector 301 is connected to the connector 30. By connecting the connector 301 to the connector 30, a platinum temperature measuring resistor (not illustrated) of the temperature sensor 100 and the measuring unit 302, which will be described later, constitute a circuit. The measuring unit 302 includes a resistor (not illustrated) constituting a bridge circuit in conjunction with a platinum temperature measuring resistor, a measuring power supply (not illustrated) for supplying power to one diagonal of the bridge circuit, and a voltage measuring unit (not illustrated) for measuring the voltage at the other diagonal of the bridge circuit. The calculation unit 303 calculates a resistance value of the platinum temperature measuring resistor based on the voltage measured by the voltage measuring unit and the resistance value of a known resistor. Further, the calculation unit 303 calculates the temperature of the platinum temperature measuring resistor (that is, the temperature of the chamber 202 detected by the temperature sensor 100) based on the resistance value of the platinum temperature measuring resistor. The calculation unit 303 may directly calculate the temperature of the platinum temperature measuring resistor from a voltage measured by the voltage measuring unit of the measuring unit 302.

The heater power source 304 is a power supply for supplying power to the heater 206. The heater controller 305 controls the power supplied from the heater power source 304 to the heater 206 so that the temperature of the chamber 202 (the temperature of the platinum temperature measuring resistor) approaches a predetermined temperature based on the temperature of the platinum temperature measuring resistor calculated by the calculation unit 303. For example, a relay (not illustrated) is disposed between the heater power source 304 and the heater 206. The heater controller 305 outputs a control signal to the relay so that the temperature of the chamber 202 approaches a predetermined target temperature based on the detected temperature (the temperature of the platinum temperature measuring resistor calculated by the calculation unit 303) of the temperature sensor 100. The relay controls the power supplied from the heater power source 304 to the heater 206 based on a control signal of the heater controller 305. For example, the heater controller 305 may control the power supplied from the heater power source 304 to the heater 206 by changing the duty ratio of the control signal in response to the difference between the target temperature and the detected temperature. The chamber 202 is heated by power supplied from the heater power source 304 to the heater 206.

[Cable with Connector]

Figure 2:
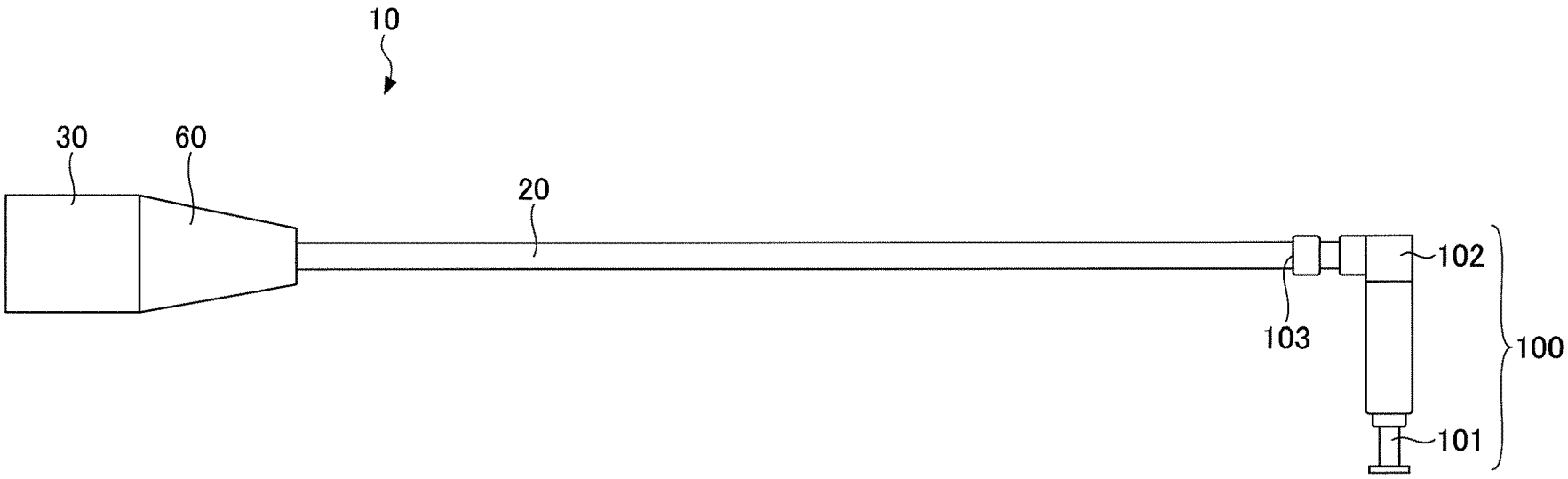
FIG. 2 is a plan view of an example of a cable with a connector according to an embodiment.
Figure 3:
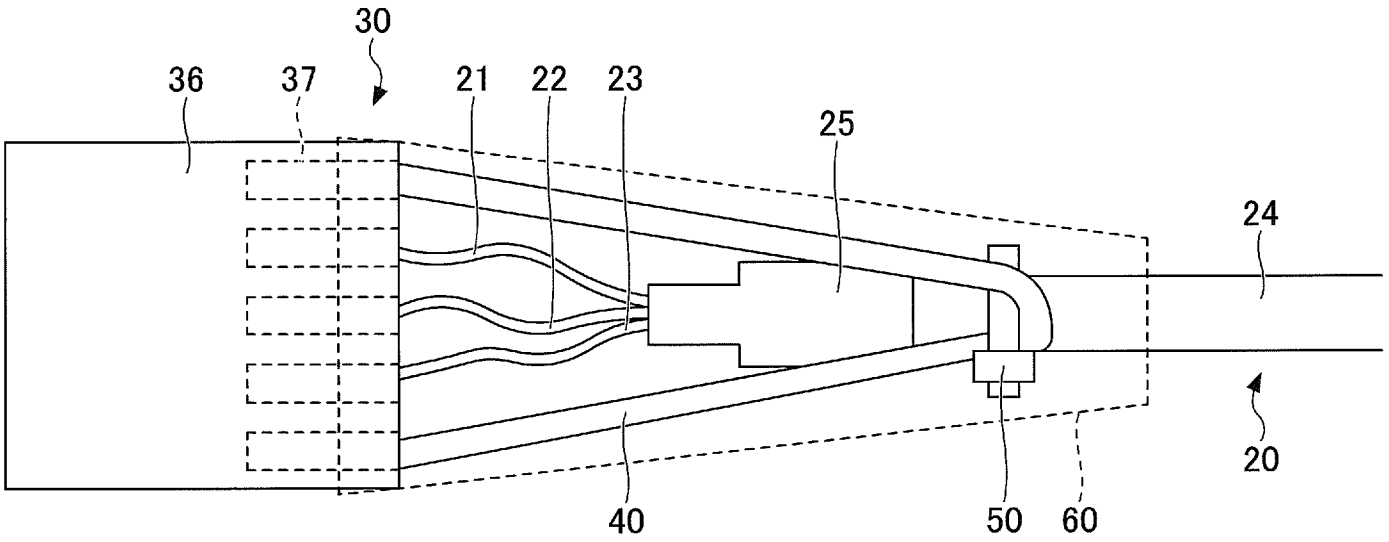
FIG. 3 is a partially enlarged view of an example of a cable with a connector according to an embodiment.
Figure 4:
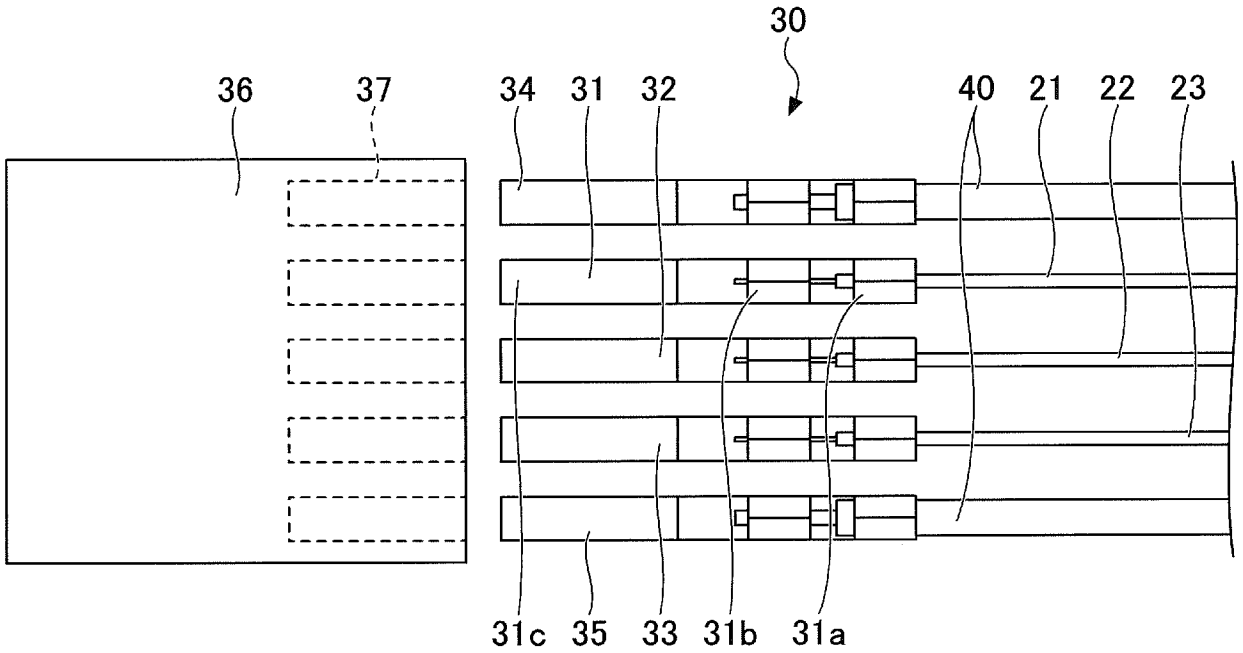
FIG. 4 is an exploded view of a cable with a connector according to an embodiment.

Next, a cable with a connector 10 according to an embodiment will be further described with reference to FIGS. 2 to 4. FIG. 2 is a plan view of an example of the cable with the connector 10 according to an embodiment. FIG. 3 is a partially enlarged view of an exemplary connector 30 portion of the cable with the connector 10 according to an embodiment. FIG. 4 is an exploded view of an exemplary connector 30 portion of the cable with the connector 10 according to an embodiment. In FIG. 3, a heat shrinkable tube 60 is illustrated by a broken line, and the inside thereof is illustrated as visible.

As illustrated in FIG. 2, the cable with the connector 10 includes a connector 30 at one end of a cable 20. A temperature sensor 100 is connected to the other end of the cable 20.

The temperature sensor 100 is, for example, a platinum temperature measuring resistor-type temperature sensor. Electrical resistance of the platinum temperature measuring resistor varies according to a temperature change. The temperature sensor 100 can measure a temperature by detecting an electrical resistance value of the platinum temperature measuring resistor. The temperature measuring resistor is not limited to platinum and may be another metal, a metal oxide or the like.

The temperature sensor 100 includes a protective tube 101 having a platinum temperature measuring resistor therein and a housing 102 having a terminal block (not illustrated) therein. The platinum temperature measuring resistor is connected to the terminal block via an internal conductor (not illustrated). The other end of the cable 20, which is an external conductor, is inserted into the housing 102 from an attachment hole 103 of the housing 102 and connected to the terminal block.

As illustrated in FIG. 3, the cable 20 is, for example, a three-core cable. The cable 20 includes insulated lead wires 21 to 23 and an outer coating 24 covering the insulated lead wires 21 to 23. At one end of the cable 20, the outer coating 24 is peeled off and lead wires 21 to 23 are exposed. A thermal shrinkable tube 25 covers the end of the outer coating 24 to protect the lead wires 21 to 23. The insulating coating is peeled off from the distal side of the lead wires 21 to 23, and the core wire is exposed.

As illustrated in FIG. 4, the connector 30 includes contacts 31 to 35 to which the lead wires 21 to 23 and a reinforcing wire 40 that is described below are attached, and a housing 36 into which the contacts 31 to 35 are inserted.

The contact 31 is attached to the lead wire 21. The contact 32 is attached to the lead wire 22. The contact 33 is attached to the lead wire 23. The contact 34 is attached to one end of the reinforcing wire 40, which will be described later. The contact 35 is attached to the other end of the reinforcing wire 40, which will be described later.

The contact 31 is integrally formed of metal. The contact 31 has an insulation barrel 31*a*, a wire barrel 31*b*, a contact portion 31*c*, and a lance (not illustrated). The insulated barrel 31*a* is fixed by crimping (tightening) the insulating coating of the lead wire 21. The wire barrel 31*b* is fixed by crimping (tightening) the core wires of the lead wire 21. The contact portion 31*c* is electrically connected with the wire barrel 31*b*. The contact portion 31*c* contacts a terminal (not illustrated) of the connector 301 (see FIG. 1) which is a member to be engaged with the connector 30 to perform an electrical connection. The lance locks the contact 31 to prevent the contact from dropping out of the housing 36. Further, the contacts 32 to 35 have the same configuration as the contact 31, and the overlapping description is omitted.

The housing 36 is made of resin such as polypropylene and nylon. The housing 36 has insertion portions 37 to receive the respective inserted contacts 31 to 35. In examples illustrated in FIGS. 3 and 4, the housing 36 has five insertion portions 37 arranged in a row. For example, the contacts 34 and 35 are to be inserted into the insertion portions 37 on both edge sides of the housing 36, Further, the contacts 31 to 33 are to be inserted into the insertion portions 37 on the inside of the insertion portions 37 into which the contacts 34 and 35 are to be inserted.

One end of the reinforcing wire 40 is crimped and fixed to the contact 34. The other end of the reinforcing wire 40 is crimped and fixed to the contact 35. The reinforcing wire 40 is preferably made of a wire that is unlikely to be broken, and is stronger than the lead wires 21 to 23, in other words, a wire that is more resistant to disconnection than the lead wires 21 to 23. For example, a wire having a larger diameter than that of the lead wires 21 to 23 may be used as the reinforcing wire 40. Further, the reinforcing wire 40 may be a lead wire having an insulating coating that is stronger than the insulating coating of the lead wires 21 to 23. Also, a lead wire having a tougher core than the cores of the lead wires 21 to 23 may be used as the reinforcing wire 40. Further, the reinforcing wire 40 is not limited to insulated lead wires, but may be metal wires or resin wires, and its material is not limited.

The reinforcing wire 40 is bent at the center of the lengthwise direction and is secured to the cable 20 (more preferably the portion of outer coating 24) by a binding band 50.

Here, as illustrated in FIG. 3, the lead wires 21 to 23 have an extra length. In other words, the lengths of the lead wires 21 to 23 are longer than the lengths of the reinforcing wire 40. For this reason, when the contacts 31 to 35 are inserted into the housing 36, and when the reinforcing wire 40 is tensely stretched, the lead wires 21 to 23 are designed to have a margin. In other words, when a force is applied in a direction of pulling the cable 20 from the housing 36, the reinforcing wire 40 is tensely stretched, but the lead wires 21 to 23 are loosely stretched.

The binding band 50 secures the bent reinforcing wire 40 to the cable 20. For example, the binding band 50 has a band portion including teeth formed therein, and a head portion formed at one end of the band portion in the lengthwise direction. The head portion has a hole to allow a band portion to be inserted, and the hole has a claw for engaging with the teeth of the band portion. The binding band 50 binds an object by inserting the other end of the band in the lengthwise direction into a hole in the head. In addition, when the teeth of the band portion and the claws of the head portion are engaged with each other, the bond by the binding band 50 is prevented from loosening. The binding band 50 preferably has a structure that prevents lateral displacement. The binding band 50 is an example of a securing member to secure the reinforcing wire 40 to the cable 20. The reinforcing wire 40 may be secured to the cable 20 by other securing members.

The heat shrinkable tube 60 is disposed from the rear of the housing 36 over the cable 20. That is, the heat shrinkable tube 60 is disposed so that the lead wires 21 to 23, reinforcing wires 40, and binding band 50 are not exposed to the outside. This protects the lead wires 21 to 23 and improves the design. In addition, because the flexibility of the cable 10 with the connector decreases by providing the thermal shrinkable tube 60, the thermal shrinkable tube 60 may not be provided for the purpose of ensuring flexibility. The heat shrinkable tube 60 may be provided so that the lead wires 21 to 23, the reinforcing wire 40, and the binding band 50 are entirely or partially exposed to the outside.

Figure 5:
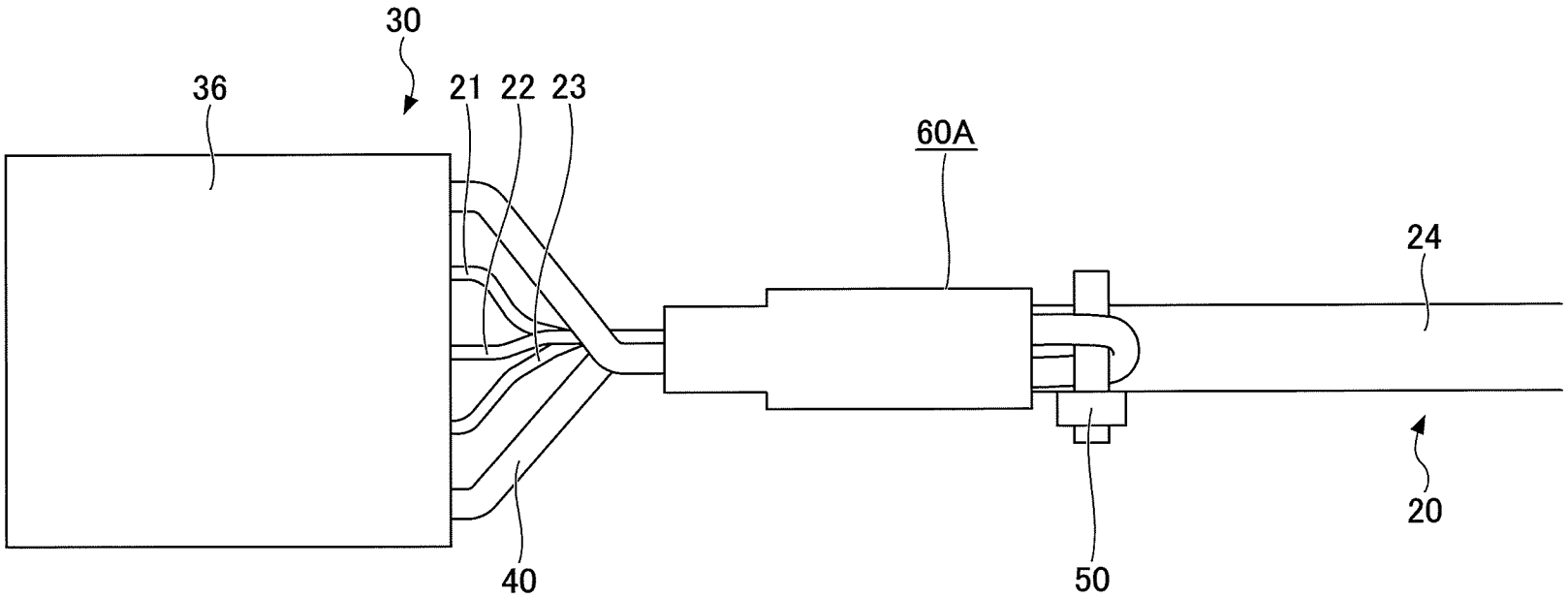
FIG. 5 is an enlarged view of another example of a connector cable according to an embodiment.

FIG. 5 is a partially enlarged view of another exemplary connector 30 portion of a cable with a connector 10 according to an embodiment. The connector 30 illustrated in FIG. 5 differs from the connector 30 illustrated in FIG. 3 in a configuration of a thermal shrinkable tube 60A. The other configurations are the same as the connector 30 in FIG. 3, and overlapping descriptions are omitted.

The thermal shrinkable tube 60A ties the reinforcing wire 40 and the cable 20. Here, the lead wires 21 to 23 and the reinforcing wires 40 are exposed externally from the rear of the housing 36 to the thermal shrinkable tube 60A. This allows the cable with the connector 10 to bend easily, for example, thereby facilitating handling of the connector 30 when attaching the connector 30 to the connector 301.

The binding band 50 is also exposed to the outside. Therefore, when the thermal shrinkable tube 60A is contracted, the adhesion between the reinforcing wire 40 and the cable 20 is improved. This reduces the lateral displacement of the binding band 50 when the reinforcing wire 40 is pulled. In addition, a thermal shrinkable tube having a smaller diameter may be used than using a thermal shrinkable tube that covers the binding band 50.

[Manufacturing Method of Cable with Connector]

Figure 6:
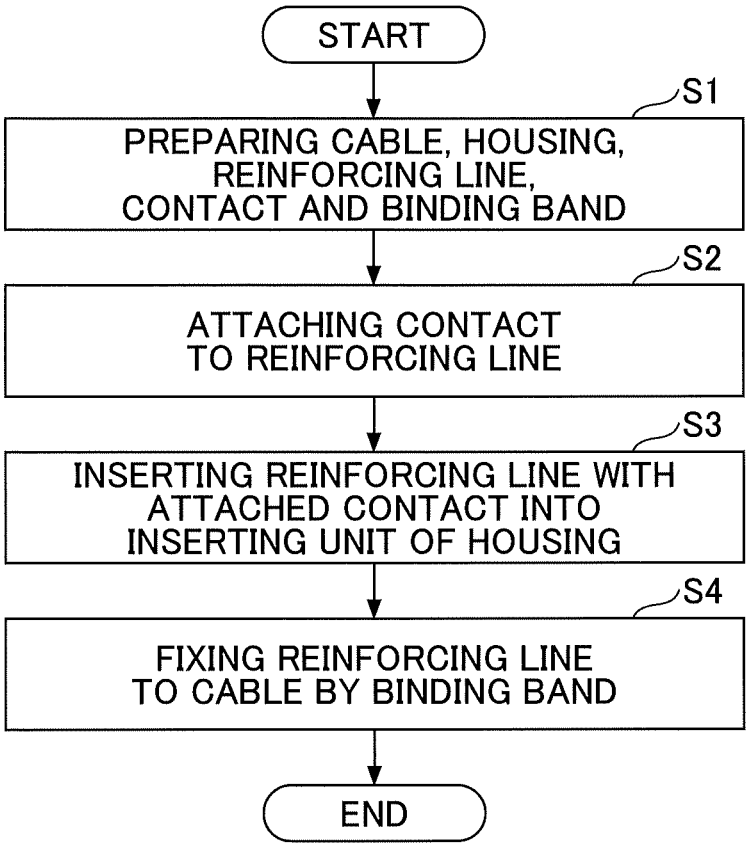
FIG. 6 is a flowchart illustrating a method for manufacturing a cable with a connector according to an embodiment.

Next, a method of manufacturing cable with a connector according to an embodiment will be described with reference to FIG. 6. FIG. 6 is a flowchart illustrating a method for manufacturing a cable with a connector 10 according to an embodiment.

In step S1, an operator prepares a cable 20*a* housing 36 connected to one end of the cable 20, a reinforcing wire 40, contacts 34 and 35, and a binding band 50. A housing 36 may be connected to one end of the cable 20. Preparation of the cable 20 connected to the housing 36 will be described. The operator strips the outer coating 24 on one end of the cable 20. The operator also heats and shrinks a heat shrinkable tube 25 to cover the end of the outer coating 24. In addition, the operator peels off the insulating coating on the distal end of the exposed lead wires 21 to 23. In addition, the operator attaches contacts 31 to 33 to the lead wires 21 to 23 (crimp). The operator then inserts the contacts 31 to 33 into the respective insertion portions 37 of the housing 36. This completes the preparation of the cable 20 connected to the housing 36.

In step S3, the operator inserts the reinforcing wire 40 to which the contacts 34 and 35 are attached into the insertion portion 37 of the housing 36.

In step S3, the operator inserts the reinforcing wire 40 to which the contacts 34 and 35 are attached into the insertion portion of the housing 36.

In step S4, the operator secures the reinforcing wire 40 to the cable 20 using a binding band 50. In this case, the fixing position of the binding band 50 is fixed in such a position that the lead wires 21 to 23 have extra lengths. That is, the lead wires 21 to 23 are secured in a loosely stretched position while the reinforcing wire 40 is tensely stretched. After the binding by the binding band 50, the extra band may be cut. The operator then heats and shrinks the thermal shrinkable tube 60 and covers the lead wires 21 to 23, reinforcing wire 40, and the binding band 50.

As described above, according to the cable with the connector 10 of one embodiment, disconnection of the lead wires 21 to 23 can be prevented. That is, the contacts 31 to 35 and the housing 36 are locked by lances (not illustrated). Therefore, when a force is applied in the direction of pulling the cable 20 from the housing 36, for example, a stress is applied to locations between the contacts 31 to 33 and the lead wires 21 to 23, which may lead to disconnection. In contrast, according to the cable with the connector 10 according to one embodiment, the reinforcing wire 40 is tensely stretched before the lead wires 21 to 23, and the lead wires 21 to 23 are loosely stretched. Thus, it is possible to prevent stress from being applied to the locations between the contacts 31 to 33 and the lead wires 21 to 23, thereby preventing the disconnection of the lead wires 21 to 23. Further, the physical connection between the insulated barrel of the contacts 34 and 35 and the reinforcing wire 40 may be maintained, and even if the core wire of the reinforcing wire 40 is broken, the disconnection of the lead wires 21 to 23 can be prevented.

By the way, if the diameters of the lead wires 21 to 23 are increased in order to prevent the disconnection, the diameter of the cable 20 also increases. If the diameter of the cable 20 becomes larger, the diameter of the mounting hole 103 of the temperature sensor 100 will not match the diameter of the hole, and it may be necessary to change the temperature sensor 100 or the design of the mounting portion of the temperature sensor 100 provided in the chamber 202.

In contrast, according to the connector cable 10 of one embodiment, because the diameter of the cable 20 can be maintained, changing the design of the temperature sensor 100 can be made unnecessary.

Because a tool for crimping and fixing the lead wires 21 to 23 to the contacts 31 to 33 can be also used as a tool for crimping and fixing the reinforcing wire 40 to the contacts 34 and 35, additional tools can be made unnecessary. Also, the binding band 50 can make a bundle without any tool. Thus, a cable with a connector 10 according to an embodiment can be manufactured without preparing any additional tools.

Although the embodiment of the cable with the connector 10 has been described, the present disclosure is not limited to the above-described embodiment, and various modifications and modifications can be made within the scope of the intention of the present disclosure as claimed.

In the examples illustrated in FIGS. 3 and 4, the case of the three-wire temperature sensor 100 is illustrated as an example, but is not limited thereto. The temperature sensor may be a two-wire temperature sensor or a four-wire temperature sensor. That is, the cable 20 of the cable with the connector 10 has been described as being a three-core cable having lead wires 21 to 23, but is not limited thereto, and may be a single-core, a two-core, or a four-core or more-core type. Also, the cable 20 has been described as coating the lead wires 21 to 23 with the outer coating 24, but is not limited thereto, and may be an unfastened wire not covered with the outer coating 24.

The housing 36 has been described as having insert sites arranged in a row, but is not limited thereto, and the insert sites may be arranged in a matrix. In this case, the contacts 34 and 35 connected to the reinforcing wire 40 are preferably inserted at a diagonal position of the insertion portions 37 arranged in a matrix.

The contacts 34 and 35 connected to the reinforcing wire 40 have been described as being inserted into the insertion portions 37 on both outer sides of the housing 36, but are not limited thereto, and may be inserted into locations between the contacts 31 and 33 of the lead wires 21 to 23. For example, the extra lengths of the lead wires 2 to 23 may be secured so that a stress may be applied to the reinforcing wire 40 first before the stress is applied to the lead wires 21 to 23.

Further, an example of the lead wires 21 to 23 with respect to the reinforcing wire 40 having extra lengths has been described, but are not limited thereto, and the extra lengths may be eliminated. Even in such a configuration, because the stress can be dispersed between the lead wires 21 to 23 and the reinforcing wire 40, disconnection of the lead wires 21 to 23 can be reduced.

Further, according to one embodiment, the cable with the connector 10 has been described by citing an example of a temperature sensor 100 being connected with the other end of the cable 20, but is not limited thereto. For example, other sensors may be connected to the other end of the cable 20, or a connector may be provided.

The reinforcing wire 40 has been described as having the contacts 34 and 35 attached to both ends and as being secured to the cable 20 approximately in the center by the binding band 50, but is not limited thereto. A first reinforcing wire attached to the contact 34 and a second reinforcing wire attached to the contacts 35 may be secured to the cable 20 by the binding band 50.

Also, the method for manufacturing the cable with the connector 10 has been described by citing an example of securing the reinforcing wire 40 to the cable 20 by the binding band 50 after inserting the contacts 34 and 35 of the reinforcing wire 40 into the insertion portions 37 of the housing 36, but is not limited thereto. After the reinforcing wire 40 is secured to the cable 20 by the binding band 50 bonding band 50, the contacts 34 and 35 of the reinforcing wire 40 may be inserted into the insertion portions of the housing 36.

Also, the timing of at contacts 34 and 35 to the reinforcing wire 40 may be prior to inserting the contacts 34 and 35 of the reinforcing wire 40 into the insertion portion 37 of housing 36 or prior to securing the reinforcing wire 40 to the cable 20 by the binding band 50, or after securing the reinforcing wire 40 to the cable 20.

Further, the timings of attaching the contacts 31 to 33 of the lead wires 21 to 23 and inserting, the contacts 31 to 33 into the insertion portion 37 of the housing 36 are not limited to the timing described above.

As described above, according to an embodiment of the present disclosure, a method for manufacturing a cable with a connector and a cable with a connector that prevent disconnection can be provided.

All examples recited herein are intended for pedagogical purposes to aid the reader in understanding the disclosure and the concepts contributed by the inventor to furthering the art, and are to be construed as being without limitation to such specifically recited examples and conditions, nor does the organization of such examples in the specification relate to a showing of the superiority or inferiority of the disclosure. Although the embodiments of the present disclosure have been described in detail, it should be understood that various changes, substitutions, and alterations could be made hereto without departing from the spirit and scope of the disclosure.

What is claimed is:

1. A method for manufacturing a cable with a connector, comprising steps of:

attaching a contact to a reinforcing wire;

inserting the reinforcing wire to which the contact is attached into an insertion portion of a housing, the housing being connected to one end of a cable;

securing the reinforcing wire to the cable by a securing member, the securing member being attached to the cable.

2. A cable with a connector, comprising:

a cable;

a housing connected to one end of the cable;

a reinforcing wire;

a contact connected to the reinforcing wire and inserted into an insertion portion of the housing; and a securing member securing the reinforcing wire to the cable, the securing member being attached to the cable.

3. The cable with the connector as claimed in claim 2, wherein the housing is made of resin.

4. The cable with the connector as claimed in claim 2, wherein the cable is longer than the reinforcing wire.

5. The cable with the connector as claimed in claim 2, wherein the contact is connected to one end of the reinforcing wire, and a second contact is connected to another end of the reinforcing wire.

6. The cable with the connector as claimed in claim 2, wherein the housing has a plurality of insertion portions, and the insertion portion into which the contact is inserted is located closer to an edge of the housing than an insertion portion into which the third contact is inserted.

7. The cable with the connector as claimed in claim 2, wherein the cable includes an insulated lead wire, and wherein the reinforcing wire has a higher resistance property of disconnection than a resistance property of disconnection of the lead wire.

* * * * *